US005763984A

United States Patent [19]

Day

[11] Patent Number: 5,763,984

[45] Date of Patent: Jun. 9, 1998

[54] PAPER TOWEL HOLDER

[76] Inventor: Gail M. Day, 18666 Redmond Way #0-2117, Redmond, Wash. 98052

[21] Appl. No.: 733,157

[22] Filed: Oct. 17, 1996

[51] Int. Cl.[6] ..... B65H 61/00

[52] U.S. Cl. ..... 312/34.8; 242/596.8

[58] Field of Search ..... 312/34.8; 242/588, 242/596.3, 596.8

[56] References Cited

U.S. PATENT DOCUMENTS

| | | | |
|---|---|---|---|
| 573,563 | 12/1896 | Yeakel . | |
| 936,803 | 10/1909 | Parmenter | 312/34.8 |
| 1,588,577 | 6/1926 | Heifler . | |
| 3,413,049 | 11/1968 | Smay . | |
| 3,623,676 | 11/1971 | Eckels | 242/596.8 |
| 4,177,958 | 12/1979 | Poole | 242/55.42 |
| 5,490,625 | 2/1996 | Myatt | 225/47 |

*Primary Examiner*—Peter M. Cuomo
*Assistant Examiner*—Gerald A. Anderson
*Attorney, Agent, or Firm*—Seed and Berry LLP

[57] ABSTRACT

A paper towel holder (10) formed of a base (28) that may be weighted for stability and a cover (42) sized and shaped to be slidably engaged within a channel (64) formed in the base (28). A first spindle (34) and a second spindle (54) are positioned on the base (28) and the inside of the top (56) of the cover (42) for holding the roll (16) of paper towels (20) in a vertical orientation and to permit rotation of the roll (20) on the concave sides (40) and (60) of the spindles (34, 54). A slot (62) formed in the cover (42) facilitates dispensing of the paper towels (20). The slot (62) may be angled from the vertical and formed at either an angle or a straight line to facilitate separation of the paper towels (20) from the continuous web (18) of paper towels (20). The cover (42) may be formed of tinted plastic or brushed metal to provide a decorative appearance.

4 Claims, 3 Drawing Sheets

PAPER TOWEL HOLDER

TECHNICAL FIELD

The present invention pertains to devices for holding rolls of paper towels, and, more particularly, to a device for supporting a single roll of continuous paper towel sheets in a vertical orientation and providing a decorative cover that encloses and facilitates dispensing of the paper towel sheets.

BACKGROUND OF THE INVENTION

Paper towels are typically dispensed from a roll of paper towels that is formed from a web of continuous paper towel sheets. While there are many varieties of paper towels available in the marketplace, including highly decorative and quilted paper towels as well as single-ply recycled "green" paper towels, they are manufactured with standard dimensions. More particularly, paper towels have a uniform width, and they are formed in a continuous web of perforated sheets that are rolled about a tube having a uniform diameter and a width that is at least equal to the width of the paper towel sheets.

Homeowners have several options for dispensing such paper towels. A well-known method is attaching the roll of paper towels to a the pair of brackets mounted underneath a cupboard or cabinet that includes spindles for engaging each end of the tube upon which the paper towels are rolled. When mounted in the horizontal orientation, the roll of paper towels is easily visible hanging from the cabinetry. Another well-known method is to place the paper towel roll over a vertical post mounted to a base and set on a countertop to stand vertically or mounted to a wall to extend outward horizontally. Again, with either of these methods the roll of paper towels is easily visible and can present an unsightly and cluttered appearance.

SUMMARY OF THE INVENTION

In accordance with the present invention, a paper towel holder for supporting a single roll of continuous paper towel sheets in a vertical orientation is provided. The paper towel holder includes a free-standing base that is sized and shaped to support the single roll of paper towels in a vertical orientation; a cover for mounting on the base, the cover being sized and shaped to completely enclose the single roll of paper towels, the cover being formed to have a side wall, a top wall with an inside surface, and an open bottom; a channel formed in the base that is sized and shaped to receive the open bottom on the side wall of the cover with at least an interference fit to prevent unintentional detachment of the cover from the base; and a pair of supports, one support being mounted on the base and the other support being mounted on the interior side of the top wall, the supports being sized and shaped to engage the open center in the paper towel tube when the cover is attached to the base, so that the roll of paper towels is positively engaged with the supports and is held in a vertical orientation during storing and dispensing of paper towels.

In accordance with another aspect of the present invention, each of the supports comprises a truncated cone with a top, bottom, and concave sides from the top to the bottom for positively engaging the roll of paper towels while allowing the roll of paper towels to freely rotate thereon.

In accordance with a further aspect of the present invention, a slot is formed in at least one side wall on the cover that ideally extends from an open end formed at the open bottom to adjacent the top wall, thus enabling the cover to be placed over the roll of paper towels with the web of paper towels extending into the slot. In other words, the cover can be placed over the roll of paper towels where the web of paper towels is already extending therefrom such that the slot is engaged with or is placed over the web of paper towel sheets extending from the paper towel roll.

In accordance with still yet another aspect of the present invention, the channel formed in the base and the side walls on the cover are both sized and shaped such that the side walls are releasably and slidably engaged within the channel to have an interference fit such that there is a snug engagement between the cover and the base to prevent unintentional removal of the cover from the base.

In accordance with yet a further aspect of the present invention, a device for supporting a roll of continuous paper towel sheets is provided, comprising a first supporting member for supporting one end of the roll of continuous paper towel sheets, the first supporting member including a spindle having a top, a bottom, and convex sides; a second support member for supporting the other side of the roll of continuous paper towel sheets, the second support member including a spindle having a top, a bottom and convex sides that extend from the top to the bottom; and a releasable engagement system that engages the first support member with the second support member with at least an interference fit to prevent unintentional disengagement of the first support member from the second support member.

In accordance with yet another aspect of the present invention, either one of the first support member or the second support member includes a dispensing apparatus for dispensing the web of continuous paper towel sheets, the dispensing apparatus comprising a slot sized and shaped to permit unfolded paper towel sheets to extend therethrough.

In accordance with another aspect of the present invention, the releasable engaging system comprises a groove formed in either one of the first or second support members, and a side wall formed in the other of the first and the second support members, the side wall being sized and shaped to be slidably engaged in the groove. Ideally, the side wall is engaged with the groove to have at least an interference fit to thereby achieve a snug engagement.

In accordance with yet another aspect of the present invention, the side wall is formed such that the slot has an opening at one end to enable placement of the side wall over one sheet of the web of continuous paper towel sheets.

In accordance with still yet another aspect of the present invention, the device further includes weighting of at least one of the first and second support members to provide static stability for the device when the roll of paper towels is held in a substantially vertical orientation. Ideally, the weighting comprises a base member formed of solid material, such as plastic, wood, metal, or composite material.

As will be readily appreciated from the foregoing description, the present invention provides a highly decorative and functional device for holding and dispensing paper towels. In particular, the concave-shaped spindles provide positive engagement at both ends of the tube of paper towels while enabling the roll of paper towels to freely rotate thereon. The cover is formed to have a side wall that completely encloses the roll of paper towels to prevent an unsightly appearance of the paper towels and provide a decorative feature to the kitchen or dining area in which it may be used. The slot opens to the open bottom of the cover to allow the cover to be placed over the roll of paper towels when the web is extending therefrom, such that the web will be extending through the slot in the side walls. This facilitates threading of the web of continuous paper towel sheets through the slot as the paper towel holder is assembled. Also, the decorative cover may be formed of translucent or transparent material to enable visual inspection of the paper towel roll, thus allowing a user to readily assess the remaining amount of paper towel sheets on the roll of paper towels.

BRIEF DESCRIPTION OF THE DRAWINGS

The foregoing and other features and advantages of the present invention will be more readily appreciated as the same become better understood from the following detailed description when taken in conjunction with the accompanying drawings, wherein.

DETAILED DESCRIPTION

Figure 1:
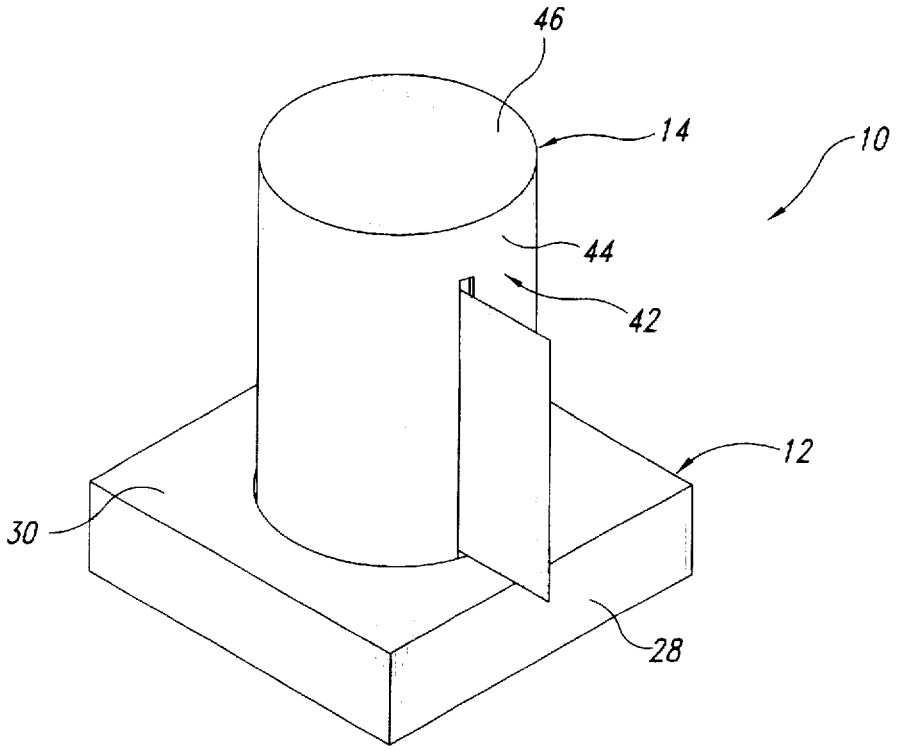
FIG. 1 is an isometric projection of the paper towel holder formed in accordance with the present invention with a web of continuous paper towel sheets being dispensed therefrom.
Figure 2:
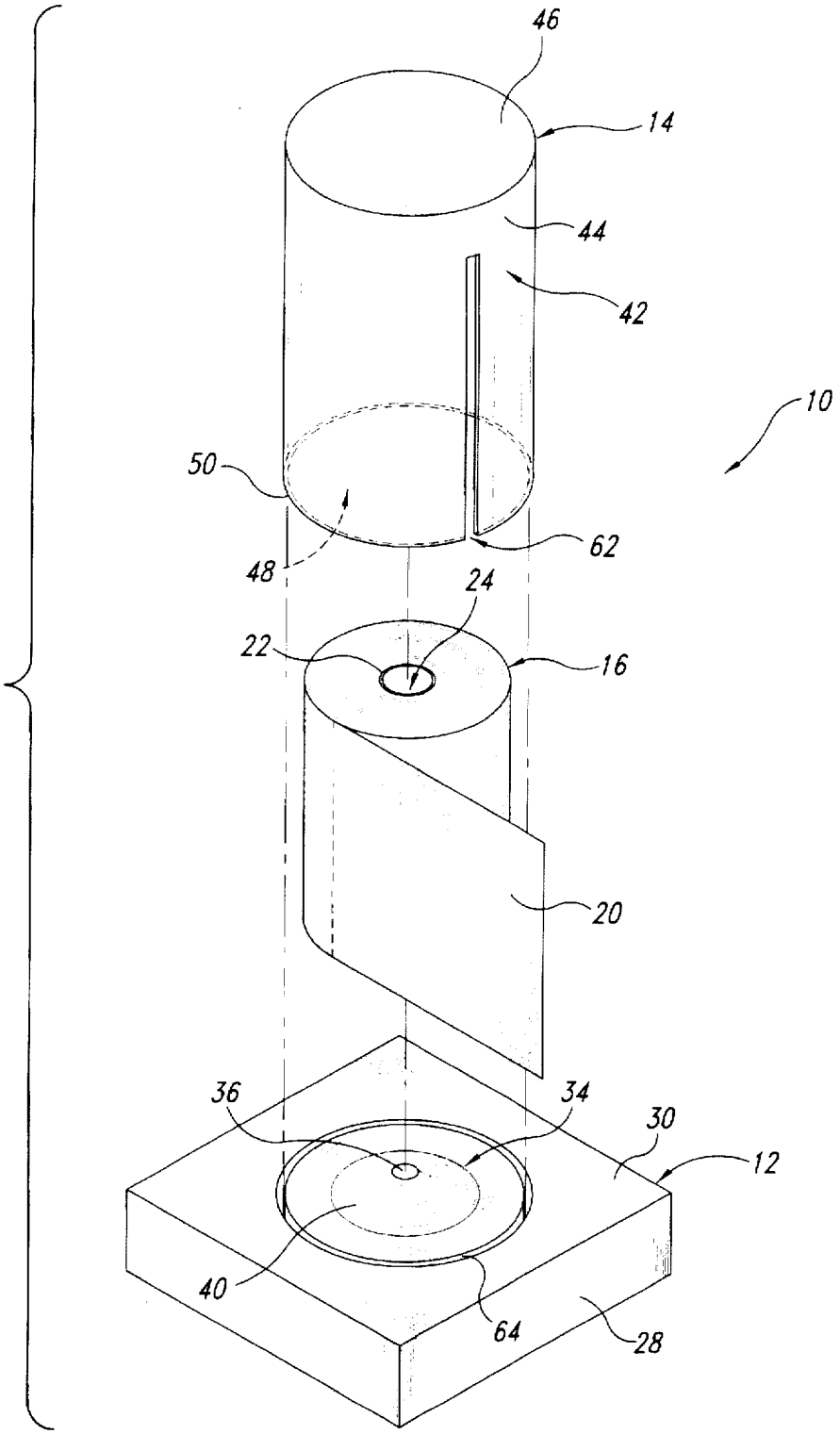
FIG. 2 is an exploded view of the paper towel holder of FIG. 1.
Figure 3:
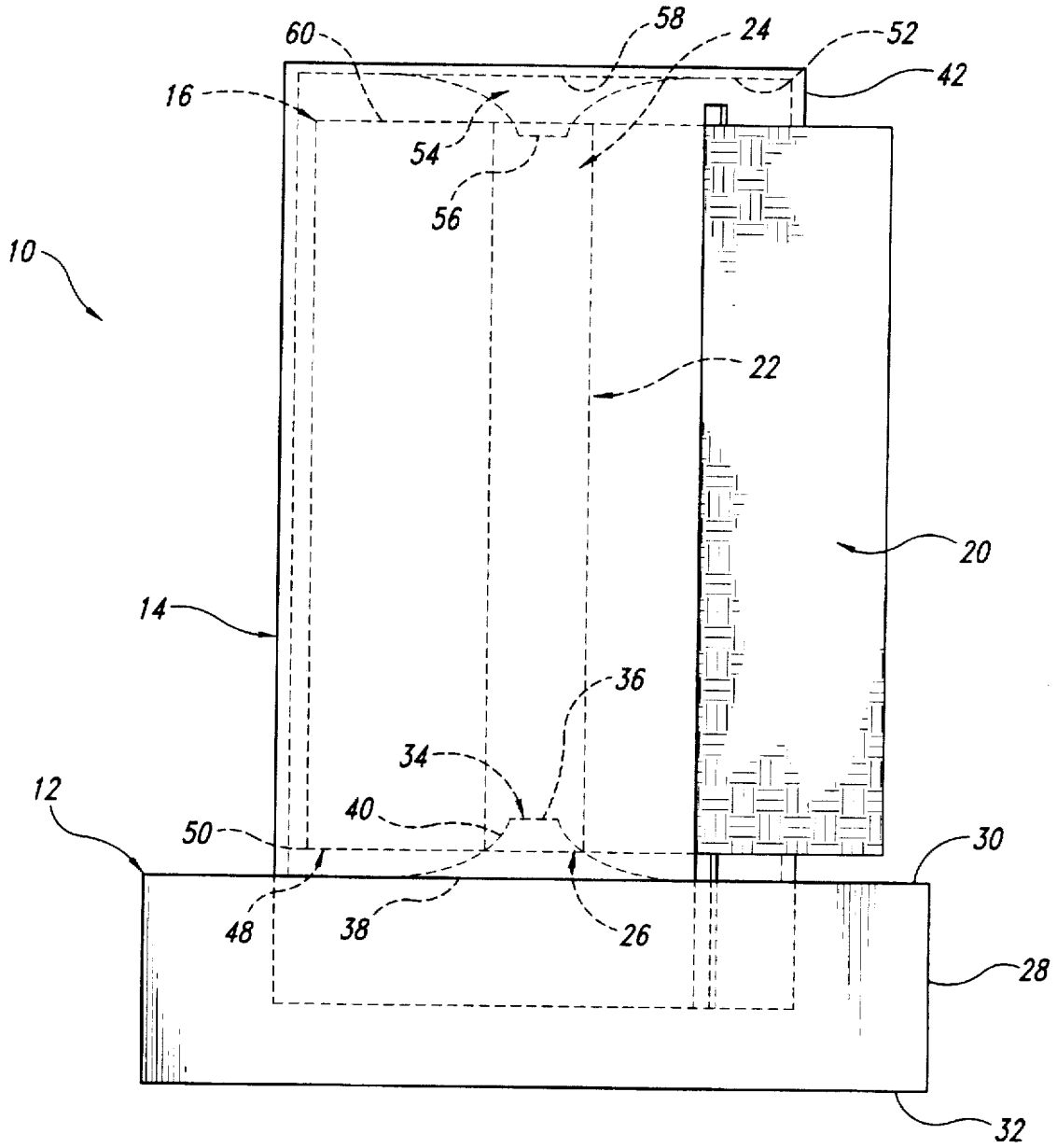
FIG. 3 is a cross-sectional illustration of the assembled paper towel holder of FIG. 1.

Referring to FIGS. 1–3, illustrated therein is a paper towel holder 10 formed in accordance with the present invention. The paper towel holder 10 includes a first support member 12 and a second support member 14 for holding and dispensing a roll 16 of continuous paper towel sheets 20 wound about a hollow cardboard tube 22 that has open ends 24 and 26. Such paper towel rolls 16 are readily commercially available and known in the art.

The first support member 12 comprises a weighted base 28 having a substantially square planform shape with a top surface 30 and bottom surface 32. Ideally, the base 28 is formed of a solid material, such as wood, metal, plastic or composite material that provides weight to the base. The weighted base provides static stability to the paper towel holder 10 and helps prevent unintentional tipping of the paper towel holder 10. The base 28 is sized and shaped to receive the roll of paper towels 20 in a vertical orientation, i.e., with the longitudinal axis of the hollow cardboard tube 22 in a vertical position.

A first spindle 34 is positioned at the center of the base 38 for supporting the paper towel roll 16. The spindle 34 is in the shape of a truncated cone having a top 36, bottom 38, and a continuous side 40. The side 40 has a concave shape from the top 36 to the bottom 38. The first spindle 34 may be a separate piece that is fixedly attached to the base 28 by conventional methods, or the spindle (34) may be integrally formed with the base 28, such as through injection molding if made of plastic or with a lathe if made of wood. The top 36 is sized to be slidably received within either one of the open ends 24, 26 of the paper towel tube 22, so that the tube 22 will bear against the concave side 40.

The second support member 14 comprises a cover 42 having a cylindrical-shaped side wall 44 with a closed top 46 and open bottom 48. The cover 42 is sized to completely enclose a single paper towel roll 16. The rim 50 circumscribing the open bottom 48 may be of the same thickness as the side wall 44 or slightly larger. The top 46 has an inside surface 52 on which is positioned a second spindle 54. The second spindle 54 has the same configuration as the first spindle 34, in that it is an inverted truncated cone with a top 56, bottom 58, and a continuous side 60 that is concave from the top 56 to the bottom 58. The top 56 of the spindle 54 is sized to be received within the other open end 26 of the paper towel tube 22, such that the tube 22 will bear against the concave side 60 for support.

A slot 62 is formed in the side wall 44 of the cover 42 to facilitate dispensing of the paper towels 20. In one embodiment, the slot 62 is parallel to the longitudinal axis of the cover 42, which is in a vertical orientation. However, to facilitate the separation or tearing apart of paper towels 20 from the continuous web 8, the slot 64 may be formed at an angle to the longitudinal axis of the cover 42. The angle of the slot 62 may vary, and the orientation may vary from either direction away from the vertical. In addition, the slot 62 may be either a straight line or curved. The angling of the slot 62 and the optional curving of the slot (62) is not only decorative, but functionally assists in tearing the paper towels 20 off the continuous web 18. In other words, by angling the paper towels 20 away from the vertical axis such that the user does not have to pull in a substantially downward direction but in a more horizontal direction, the paper towels 20 may be more easily separated. In addition, this prevents the inadvertent pulling of more paper towels 20 from the inside of the cover 42. The slot 62 may angle in the range of 1 degree from the vertical axis to plus or minus 45 degrees from the vertical axis.

The base 28 has a circular channel 64 formed in the top surface 30. In this embodiment, the channel 64 is about three-quarters of an inch deep and is concentrically positioned around the first spindle 34. The channel 64 has a substantially U-shaped cross-sectional configuration, and it is sized to slidably receive the rim 50 on the cover 42, ideally with a snug "interference" fit. With the cover 42 so engaged to the base 28, it more readily remains in place during use, especially when paper towels 20 are being torn off.

In one embodiment, the cover 42 is formed of plastic material that may be transparent, opaque, or translucent. Transparent material will enable a user to visually determine the amount of paper towels 20 left on the roll 16. For more decorative applications, the plastic may be colored or tinted, or a metal cover may be used, such as that formed from brushed aluminum or steel.

While a preferred embodiment of the invention has been illustrated and described, it is to be understood that various changes may be made therein without departing from the spirit and scope of the invention. Consequently, the invention is to be limited only by the scope of the claims that follow.

The embodiments of the invention in which an exclusive property or privilege is claimed are defined as follows:

1. A device for supporting a single roll of paper towels in a vertical orientation, the roll of paper towels having a centrally-disposed tube with open ends, the device comprising:

a free-standing base sized and shaped to support the roll of paper towels in a vertical orientation;

a cover sized and shaped to be mounted on said base and completely enclose the roll of paper towels, said cover further comprising a side wall, a top wall, and an open bottom circumscribed by a rim on said side wall;

a channel formed in said base, said channel sized and shaped to receive said rim of said cover with at least an interference fit to prevent unintentional detachment of said cover from said base;

a pair of supports, comprising a first support mounted on said base and a second support mounted on an interior side of said top wall of said cover, each of said supports sized and shaped to engage the open end of the roll of paper towels when said cover is attached to said base so that the roll of paper towels is held in a vertical orientation about a vertical axis during storing and dispensing of paper towels, and a slot formed in said side wall of said cover having one end open at said open bottom of said cover and extending to adjacent said top wall, said slot being formed at an angle in the range of 1 to 45 degrees in either direction from the vertical axis such that when a paper towel extending through said slot is torn, said cover is urged into said base.

2. The device of claim 1, wherein said supports comprise a truncated cone with a top, a bottom, and sides having a concave configuration from the top to the bottom for positively engaging the roll of paper towels.

3. The device of claim 1, wherein said base further includes means for weighting said base to provide static stability to the holder and to resist unintentional tipping of the holder.

4. The device of claim 3, wherein said cover is formed of transparent material that enables visual perception of the roll of paper towels when enclosed by said cover.

* * * * *